US007377670B2

(12) United States Patent
Takezawa

(10) Patent No.: US 7,377,670 B2
(45) Date of Patent: May 27, 2008

(54) ILLUMINATION DEVICE AND PROJECTOR EQUIPPING THE SAME

(75) Inventor: Takeshi Takezawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 185 days.

(21) Appl. No.: 10/798,448

(22) Filed: Mar. 12, 2004

(65) Prior Publication Data

US 2005/0047141 A1 Mar. 3, 2005
US 2005/0190554 A9 Sep. 1, 2005

(30) Foreign Application Priority Data

Mar. 24, 2003 (JP) ..... 2003-079437

(51) Int. Cl.
*F21V 29/00* (2006.01)
*F21V 7/00* (2006.01)

(52) U.S. Cl. ..... 362/264; 362/298; 362/346; 362/263; 362/267; 362/310; 313/46; 313/114

(58) Field of Classification Search ..... 313/46, 313/113, 114, 489, 635, 634, 17, 25, 318.11; 362/507, 509, 510, 514, 519, 538–539, 549, 362/255–256, 261–264, 294, 296, 298, 346, 362/267, 310, 293
See application file for complete search history.

(56) References Cited

U.S. PATENT DOCUMENTS 3,988,626 A * 10/1976 Boudouris ..... 313/113
4,305,099 A 12/1981 True et al.
6,008,568 A * 12/1999 Pitel et al. ..... 313/46
6,734,628 B2 * 5/2004 Seki et al. ..... 313/623
6,784,601 B2 * 8/2004 Kai et al. ..... 313/46
6,821,005 B2 * 11/2004 Uchida et al. ..... 362/466
2005/0024880 A1 * 2/2005 Moench et al. ..... 362/342
2005/0218769 A1 * 10/2005 Ritz et al. ..... 313/113

FOREIGN PATENT DOCUMENTS

| | | |
|---|---|---|
| EP | 1 134 778 A2 | 9/2001 |
| JP | A-5-3019 | 1/1993 |
| JP | A-5-283051 | 10/1993 |
| JP | A-6-314502 | 11/1994 |
| JP | A-7-192688 | 7/1995 |
| JP | A-8-31382 | 2/1996 |
| JP | A-9-120067 | 5/1997 |
| JP | A-10-92385 | 4/1998 |
| JP | A-10-106493 | 4/1998 |
| JP | A-11-162407 | 6/1999 |
| JP | A-11-317197 | 11/1999 |
| JP | A-2002-151005 | 5/2002 |

* cited by examiner

*Primary Examiner*—Thomas M. Sember
(74) *Attorney, Agent, or Firm*—Oliff & Berridge, PLC

(57) ABSTRACT

Exemplary embodiments of the present invention include a second reflector attached to a sealing portion so that its reflection surface may surround substantially the front half of a light emitting portion, the heat capacity of a front-side electrode surrounded with the second reflector is made larger than that of a rear-side electrode, an electrode shaft which supports the front-side electrode surrounded with the second reflector is made thicker and/or longer than an electrode shaft which supports the rear-side electrode, the front-side sealing portion to which the second reflector is attached is made thicker than a rear-side sealing portion, and the front-side sealing portion, to which the second reflector is attached is coated with a heat radiation material which has a thermal conductivity higher than that of the material of this sealing portion.

24 Claims, 6 Drawing Sheets

ILLUMINATION DEVICE AND PROJECTOR EQUIPPING THE SAME

BACKGROUND OF THE INVENTION

1. Field of Invention

The present invention relates to an illumination apparatus having a light emitting tube, and a reflector which reflects emergent light from the light emitting tube, and a projector including the illumination apparatus.

2. Description of Related Art

A related art illumination apparatus includes a light emitting tube, and a reflector to turn light emitted from the light emitting tube into a predetermined direction. In such an illumination apparatus, in order to effectively utilize stray light emitted from the light emitting tube and not put into use, a second auxiliary reflector is installed at a position opposite to the first-mentioned reflector with the light emitting tube interposed therebetween, as disclosed in related art document JP-A-8-31382 (page 2, FIG. 1).

SUMMARY OF THE INVENTION

However, in such a case where the second auxiliary reflector is mounted on the light emitting tube so as to surround the periphery of the light emitting portion of the light emitting tube, it acts to decrease the quantity of heat radiation of the light emitting tube. Therefore, the temperatures of the light emitting tube, including electrodes, exhibit a nonuniform temperature distribution. Accordingly, the temperatures rise greatly at parts, resulting in the problem that the temperature rise incurs the consumption of the electrodes and the whitening and expansion of the light emitting tube, thus, shortening the lifetime of the light emitting tube.

Exemplary embodiments of the present invention address the above and/or other problems, and provide an illumination apparatus including a light emitting tube which can reduce or prevent its lifetime and reliability from degrading due to a second reflector even in a case where, in an illumination apparatus having the light emitting tube, a first reflector being a main reflector, and the second reflector being an auxiliary reflector, the second reflector is mounted on the light emitting tube so as to surround the periphery of the light emitting portion of the light emitting tube. Exemplary embodiments also provide a projector which includes the illumination apparatus.

An illumination apparatus of the exemplary embodiments of the present invention includes an illumination apparatus including a light emitting tube, a first reflector and a second reflector. The light emitting tube has a light emitting portion performing light emission between a pair of electrodes, and a sealing portion located on a front side and a sealing portion located on a rear side with the light emitting portion interposed therebetween. The first reflector is arranged on a rear side with respect to the light emitting portion of the light emitting tube. The second reflector is arranged on a front side with respect to the light emitting portion, and attached to the sealing portion located on the front side, so that its reflection surface may surround substantially a front half of the light emitting portions. Accordingly, a heat capacity of the front-side electrode of the pair of electrodes as is surrounded with the second reflector, is made larger than a heat capacity of the rear-side electrode.

Thus, much of the light from the light emitting tube that usually becomes stray light, is forced to retrocede to the first reflector through the second reflector and can be put into use.

Nevertheless, since the heat capacity of the front-side electrode surrounded with the second reflector is larger than that of the rear-side electrode, the heat load of the front-side electrode is lightened, and the temperature rise rate thereof lowers, so that thermal influence ascribable to the second reflector can be reduced or relieved. Accordingly, the temperature distribution of the light emitting portion becomes uniform, and the lifetime and reliability of the light emitting tube can be maintained for a long term.

Exemplary embodiments of the present invention provide in an illumination apparatus including a light emitting tube, a first reflector and a second reflector. The light emitting tube has a light emitting portion performing light emission between a pair of electrodes, and a sealing portion located on a front side and a sealing portion located on a rear side with the light emitting portion interposed therebetween. The first reflector is arranged on a rear side with respect to the light emitting portion of the light emitting tube. The second reflector is arranged on a front side with respect to the light emitting portion, and attached to the sealing portion located on the front side, so that its reflection surface may surround substantially front half of said light emitting portion. Accordingly, an electrode shaft which supports the front-side electrode of the pair of electrodes and is surrounded with the second reflector, is made thicker and/or longer than an electrode shaft which supports the rear-side electrode.

Thus, much of the light from the light emitting tube that usually becomes stray light is forced to retrocede to the first reflector through the second reflector and can be put into use. Nevertheless, since the front-side electrode shaft surrounded with the second reflector is thicker and/or longer than the rear-side electrode shaft, the heat of the front-side electrode shaft can easily be conducted to the sealing portion to the corresponding extent so as to quicken heat radiation. Thus, in spite of the installation of the second reflector, thermal influence ascribable thereto can be reduced or relieved. Accordingly, the temperature distribution of the light emitting portion becomes uniform, and the lifetime and reliability of the light emitting tube can be maintained for a long term.

Exemplary embodiments of the present invention provide an illumination apparatus including a light emitting tube, a first reflector and a second reflector. The light emitting tube has a light emitting portion performing light emission between a pair of electrodes, and a sealing portion located on a front side and a sealing portion located on a rear side with the light emitting portion interposed therebetween. The first reflector is arranged on a rear side with respect to the light emitting portion of the light emitting tube. The second reflector is arranged on a front side with respect to the light emitting portion, and attached to the sealing portion located on the front side, so that its reflection surface may surround substantially front half of the light emitting portions. Accordingly, the sealing portion located on the front side with the second reflector attached thereto, is made thicker than the sealing portion located on the rear side.

Thus, much of the light from the light emitting tube that usually becomes stray light, is forced to retrocede to the first reflector through the second reflector and can be put into use. Nevertheless, since the front-side sealing portion surrounded with the second reflector is thick, the temperature of the sealing portion located on the front side becomes difficult to rise and a radiation area enlarges to the corresponding extent, so that in spite of the installation of the second reflector, thermal influence ascribable thereto can be reduced or relieved. Accordingly, the temperature distribution of the light emitting portion becomes uniform, and the lifetime and reliability of the light emitting tube can be maintained for a long term.

Exemplary embodiments of the present invention provide an illumination apparatus including a light emitting tube, a first reflector and a second reflector. The light emitting tube has a light emitting portion performing light emission between a pair of electrodes, and a sealing portion located on a front side and a sealing portion located on a rear side with the light emitting portion interposed therebetween. The first reflector is arranged on a rear side with respect to the light emitting portion of the light emitting tube. The second reflector is arranged on a front side with respect to the light emitting portion, and attached to the sealing portion located on the front side, so that its reflection surface may surround substantially front half of said light emitting portions. Accordingly, the sealing portion located on the front side is coated with a heat radiation material which is higher in thermal conductivity than a material of the sealing portion.

Thus, much of the light from the light emitting tube that usually becomes stray light is forced to retrocede to the first reflector through the second reflector and can be put into use. Nevertheless, since heat can easily be emitted through the heat radiation material from the front-side sealing portion surrounded with the second reflector, raising of the temperature of the sealing portion located on the front side becomes difficult to the corresponding extent, and in spite of the installation of the second reflector, thermal influence ascribable thereto can be reduced or relieved. Accordingly, the temperature distribution of the light emitting portion becomes uniform, and the lifetime and reliability of the light emitting tube can be maintained for a long term.

Exemplary embodiments of the present invention provide an illumination apparatus including a light emitting tube, a first reflector and a second reflector. The light emitting tube has a light emitting portion performing light emission between a pair of electrodes, and a sealing portion located on a front side and a sealing portion located on a rear side with the light emitting portion interposed therebetween. The first reflector is arranged on a rear side with respect to the light emitting portion of the light emitting tube. The second reflector is arranged on a front side with respect to the light emitting portion, and attached to the sealing portion located on the front side, so that its reflection surface may surround substantially front half of the light emitting portion. Accordingly, an end part of the front-side electrode surrounded with the second reflector is held in touch with an inner surface of the light emitting tube.

Thus, much of the light from the light emitting tube that usually becomes stray light is forced to retrocede to the first reflector through the second reflector and can be put into use. Nevertheless, since the end part of the front-side electrode surrounded with the second reflector is held in touch with the inner surface of the light emitting tube, raising the temperature of the front-side electrode becomes difficult to the corresponding extent, and in spite of the installation of the second reflector, thermal influence ascribable thereto can be reduced or relieved. Accordingly, the temperature distribution of the light emitting portion becomes uniform, and the lifetime and reliability of the light emitting tube can be maintained for a long term.

Exemplary embodiments of the present invention provide an illumination apparatus including a light emitting tube, a first reflector and a second reflector. The light emitting tube has a light emitting portion performing light emission between a pair of electrodes, and a sealing portion located on a front side and a sealing portion located on a rear side with the light emitting portion interposed therebetween. The first reflector is arranged on a rear side with respect to the light emitting portion of the light emitting tube. The second reflector is arranged on a front side with respect to the light emitting portion, and attached to the sealing portion located on the front side, so that its reflection surface may surround substantially front half of the light emitting portion. Accordingly, a wall thickness of that front side of the light emitting portion of the light emitting tube which is surrounded with the second reflector is greater than a wall thickness of a rear side of the light emitting portion.

Thus, much of the light from the light emitting tube that usually becomes stray light is forced to retrocede to the first reflector through the second reflector and can be put into use. Nevertheless, since the wall thickness of that front side of the light emitting portion of the light emitting tube which is surrounded with the second reflector is greater than the wall thickness of the rear side of the light emitting portion, raising of the temperature of the front side of the light emitting tube becomes difficult to the corresponding extent, and in spite of the installation of the second reflector, thermal influence ascribable thereto can be reduced or relieved. Accordingly, the temperature distribution of the light emitting portion becomes uniform, and the lifetime and reliability of the light emitting tube can be maintained for a long term.

By the way, in the above exemplary illumination apparatus, the end part of at least one of the pair of electrodes should preferably be held in touch with the inner surface of the light emitting tube.

Accordingly, the heat load of at least one of the pair of electrodes can be lightened still more.

Further, another exemplary illumination apparatus of the present invention provides an illumination apparatus including a light emitting tube which has a light emitting portion performing light emission between a pair of electrodes, and a sealing portion located on a front side and a sealing portion located on a rear side with the light emitting portion interposed therebetween. A first reflector is arranged on a rear side with respect to the light emitting portion of the light emitting tube, and a second reflector is arranged on a front side with respect to the light emitting portion, characterized in that the second reflector is attached to the sealing portion located on the front side, so that its reflection surface may surround substantially front half of the light emitting portion. Accordingly, a pair of electrode shafts which support the pair of electrodes, respectively, are included, the pair of electrode shafts are respectively furnished with heat conduction parts at their end parts on sides on which they are connected with said pair of electrodes, and a heat capacity of the heat conduction part of the front-side electrode of the pair of electrodes as is surrounded with the second reflector is made larger than a heat capacity of the heat conduction part of the rear-side electrode.

Thus, much of the light from the light emitting tube that usually becomes stray light is forced to retrocede to the first reflector through the second reflector and can be put into use. Nevertheless, since the front-side heat conduction part surrounded with the second reflector is larger in the heat capacity than the rear-side heat conduction part, the heat of the front-side electrode near which the second reflector is more easily radiated, the heat load of the front-side electrode is lightened to lower the temperature rise rate thereof, and the temperature difference of the front-side electrode from the rear-side electrode is diminished. Accordingly, the temperature distribution of the light emitting portion becomes uniform, and the lifetime and reliability of the light emitting tube can be maintained for a long term.

A projector of exemplary embodiments of the present invention includes a projector having an illumination apparatus, and an optical modulation device into which light from the illumination apparatus is entered and which modulates the entered light in accordance with given image information, characterized in that any of the illumination apparatuses defined in exemplary embodiments above is included as the illumination apparatus. Thus, a projector of high brightness and long lifetime can be obtained.

DETAILED DESCRIPTION OF PREFERRED EMBODIMENTS

Figure 1:
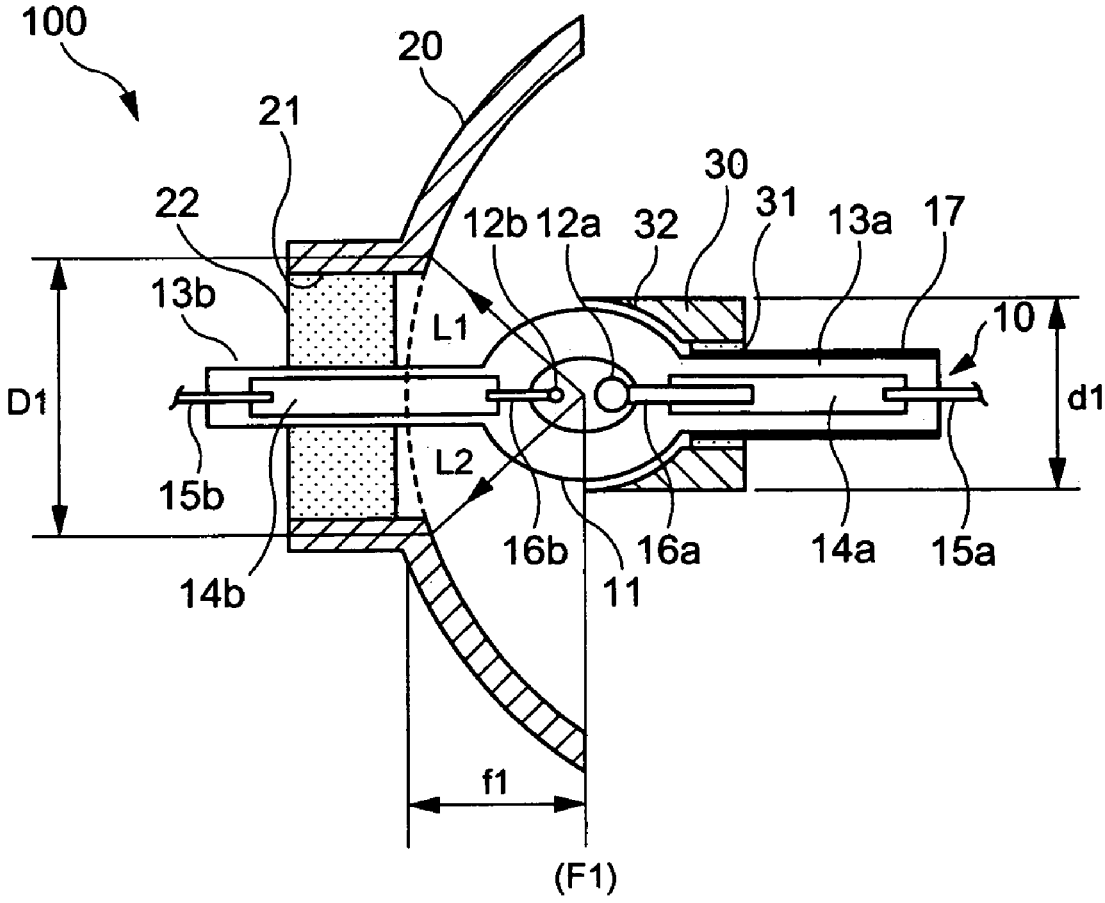
FIG. 1 is a schematic constructional view showing an illumination apparatus according to the first exemplary embodiment of the present invention.

Exemplary embodiments of the present invention will be described with reference to the drawings. Incidentally, throughout the drawings, the same reference numerals and signs shall designate identical constituents or corresponding constituents.

First Exemplary Embodiment

Figure 2:
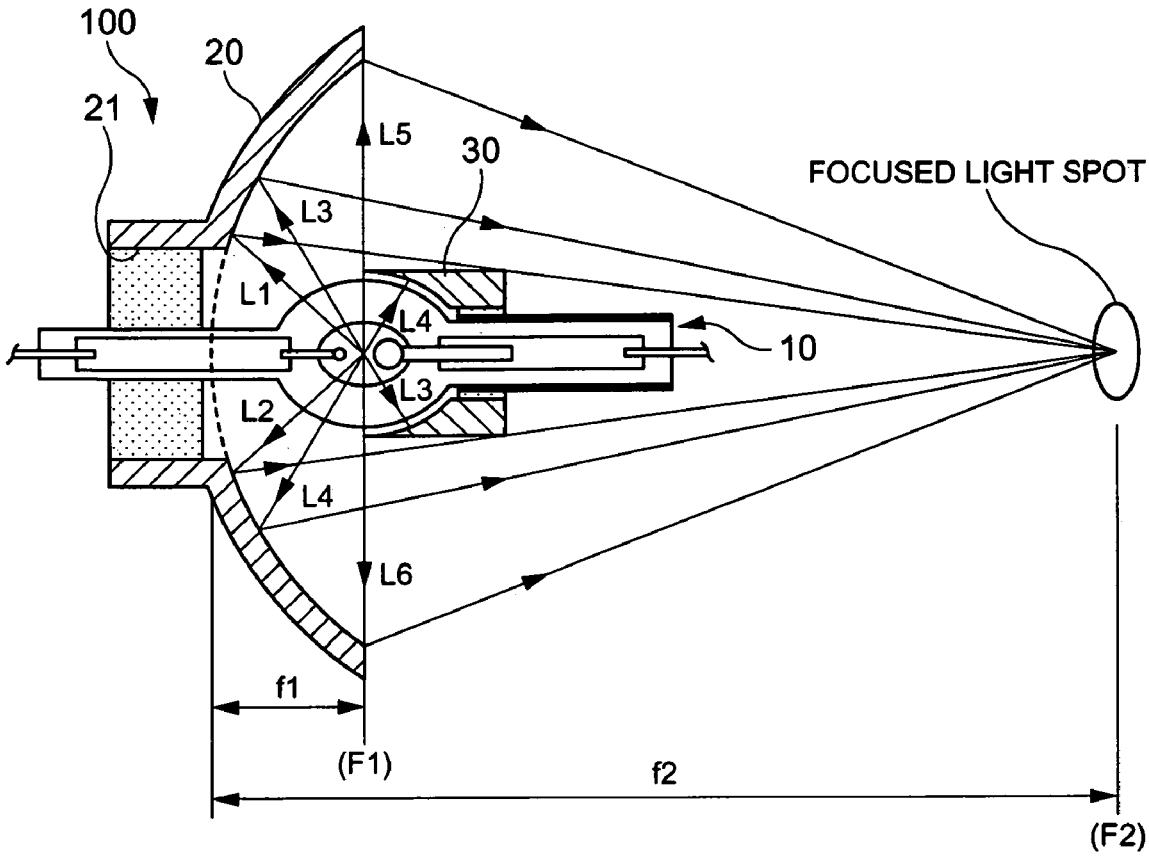
FIG. 2 is a schematic that explains the operation of the illumination apparatus in FIG. 1.

FIG. 1 is a schematic constructional view of an illumination apparatus 100 according to an exemplary embodiment of the present invention. FIG. 2 is a schematic that shows the operation of the apparatus 100 in FIG. 1.

The illumination apparatus 100 includes a light emitting tube 10, a first reflector 20 which is the main reflector of the illumination apparatus 100, and a second reflector 30 which is the auxiliary reflector of the illumination apparatus 100.

In the description of this exemplary embodiment, the "front side" shall indicate the illumination light emergence side of the illumination apparatus 100.

The light emitting tube 10 is made of silica glass or the like, and it includes therein a pair of electrodes 12*a*, 12*b* of tungsten, a central light-emitting portion 11 which is filled with mercury, a rare gas and a small quantity of halogen, and sealing portions 13*a* and 13*b* as are respectively located on the front side and rear side with the light emitting portion 11 interposed therebetween. Metal foils 14*a*, 14*b* of molybdenum connected with the corresponding electrodes 12*a*, 12*b* are hermetically sealed in the respective sealing portions 13*a*, 13*b*, and they are respectively furnished with leads 15*a*, 15*b* which are connected to the exterior, and conductive, electrode shafts 16*a*, 16*b* which support the corresponding electrodes 12*a*, 12*b*. Incidentally, the connection destinations of the leads 15*a*, 15*b* may be the same as in related art devices, and these leads are connected to, for example, external connection terminals disposed in an illumination apparatus fixture or the like, not shown.

When the outer peripheral surface of the light emitting portion 11 is formed with an anti-reflection coating which is a multilayer film including a tantalum oxide film, a hafnium oxide film, a titanium oxide film or the like, light loss ascribable to the reflection of light passing therethrough can be relieved.

The reflection surface of the first reflector 20 is in the shape of a curve of revolution, and F1, F2 indicate the first focal point and second focal point of the curve of revolution of the reflection surface of the first reflector 20, while f1, f2 denote distances from the vertex of the curve of revolution of the reflection surface of the first reflector 20 to the first focal point F1 and second focal point F2, respectively. Incidentally, the reflection surface of the first reflector 20 can adopt the shape of an ellipsoid of revolution, the shape of a paraboloid of revolution, or the like. The first reflector 20 is a reflective element which is arranged on the rear side of the light emitting portion 11 in the illumination apparatus 100 including the light emitting tube 10, and the central part of which is provided with a through hole 21 for fixing the light emitting tube 10. The light emitting tube 10 is secured in the through hole 21 of the first reflector 20 by an inorganic type adhesive 22 such as cement, with the axes of the light emitting tube 10 and the first reflector 20 held in agreement. The axis of the light emitting tube 10 is the center axis of this light emitting tube 10 in the longitudinal direction thereof, and it is substantially in agreement with a line which joins the electrodes 12*a* and 12*b*. Besides, the axis of the first reflector 20 is the axis of revolution of the curve of revolution forming the reflection surface of the first reflector 20, and it is substantially in agreement with the center axis of a light beam emitted from the illumination apparatus 100. In the case where the reflection surface of the first reflector 20 is in the shape of the ellipsoid of revolution, the center of the light emitting portion 11 of the light emitting tube 10 (the midpoint between the electrodes 12*a* and 12*b*) is located in agreement with, or in the vicinity of, the first focal point (F1) of the ellipsoid of revolution. In the case where the reflection surface of the first reflector 20 is in the shape of the paraboloid of revolution, it is located in agreement with, or in the vicinity of, the focal point F of the paraboloid of revolution. That is, the center of the light emitting portion 11 is arranged near the focal point F1 or F of the first reflector 20 or substantially in agreement with the position of the focal point F1 or F.

The second reflector 30 is a reflective element which is arranged on the front side of the light emitting portion 11 in the illumination apparatus 100 which includes the light emitting tube 10, and which is arranged so that its reflection surface 32 may surround substantially the front half of the light emitting portion 11, and that incident light which is emitted from the center of the light emitting portion 11 to enter this reflection surface 32 of the second reflector 30 may come into agreement with normal lines to the reflection surface 32 of the second reflector 30. Here, the second reflector 30 is fixed to the sealing portion 13*a* by a adhesive 31. Since the structure of the light emitting portion 11 (the relative position between the electrode 12*a* and the electrode 12*b*, the shapes of the individual parts of the light emitting portion 11, and so forth) differs every light emitting tube 10 on account of a manufacturing dispersion, etc., the shape of the reflection surface 32 of the second reflector 30 should preferably be determined every light emitting tube 10 in accordance with its relation with the light emitting portion 11.

Further, since the second reflector 30 is exposed to high temperatures of about 900-1000° C., it needs to be fabricated of a material of excellent heat resistance. By way of example, when the second reflector 30 is fabricated by utilizing quartz or Neoceram, which is a material of low thermal expansibility, or light-transmissive alumina, sapphire, rock crystal, fluorspar, YAG or the like, which is a material of high thermal conductivity, deformation, deterioration, etc. ascribable to heat can be reduced or prevented. Utilizable as the light-transmissive alumina is, for example, an article of commerce "Sumicorundom" (Sumicorundom is a registered trademark of Sumitomo Chemical Co., Ltd.).

If the reflection surface 32 of the second reflector 30 can reflect only visible radiation for use in illumination and pass ultraviolet radiation and infrared radiation unnecessary for the illumination, then heat to be generated in the second reflector 30 can be lessened. Therefore, a dielectric multilayer film which reflects only the visible radiation therefrom and passes the ultraviolet and infrared radiations therethrough is stacked on the reflection surface 32 of the second reflector 30 here. The dielectric multilayer film also requires heat resistance, and it can be constructed of, for example, the alternate stacking of a tantalum compound and $SiO_2$ or the alternate stacking of a hafnium compound and $SiO_2$. With the above factors taken into consideration, the quartz, light-transmissive alumina, rock crystal, sapphire, YAG ($Y_3Al_5O_{12}$), fluorspar, etc. are mentioned as materials which are low in thermal expansibility or superior in the thermal conductivity and which can easily transmit the ultraviolet and infrared radiations. The second reflector 30 should preferably be fabricated of any of the materials.

Incidentally, the outer side surface of the second reflector 30 should preferably be formed so as to transmit light having entered without being reflected by the reflection surface 32 thereof (infrared radiation, ultraviolet radiation, visible radiation having leaked in from the side of the reflection surface 32, and so forth), or to include a reflective film or shape which diffuses and reflects the light having entered without being reflected by the reflection surface 32, whereby the second reflector 30 avoids absorbing the light to the utmost.

Further, the diameter d1 of the outer side surface of the second reflector 30 is set so that the diameter D1 of a cone on the reflection surface of the first reflector 20, the cone being indicated by available limitation lights L1, L2 emergent from the light emitting portion 11 onto the side of the first reflector 20, i.e., onto the rear side of the illumination apparatus 100 as shown in FIG. 1, may become larger than the diameter d1 of the outer side surface of the second reflector 30. That the diameter d1 of the outer side surface of the second reflector 30 may have a value which lies inside a cone that is formed by the reflected lights of the available limitation lights L1, L2 as reflected by the first reflector 20. Thus, that light component of light emitted from the light emitting portion 11 onto the rear side of the illumination apparatus 100 which lies within an available range can proceed without being intercepted by the second reflector 30, after it has been reflected by the first reflector 20.

The "available limitation lights L1, L2" signify those light components of the light emitted from the light emitting portion 11 onto the rear side of the illumination apparatus 100 which correspond to the inner boundaries of the range where the light is actually available as the illumination light. They are determined by the structure of the light emitting tube 10 in some cases, and by the structure of the first reflector 20 in the other cases. The "available limitation lights which are determined by the structure of the light emitting tube 10" are the effective lights of boundaries with lights intercepted under the influence of the sealing portion 13*b*, etc., among lights which emerge from the light emitting portion 11 onto the side of the first reflector 20, i.e., onto the rear side and which are emitted as the effective lights without being intercepted under the influence of the sealing portion 13*b*, etc. Besides, the "available limitation lights which are determined by the structure of the first reflector 20" are the effective lights of boundaries with lights which cannot be reflected by the reflection surface of the first reflector 20 and become unavailable as the illumination light on account of the first reflector 20, such as of the existence of the through hole 21 of the first reflector 20, among the lights which emerge from the light emitting portion 11 onto the side of the first reflector 20, i.e., onto the rear side of the illumination apparatus 100 and which are emitted as the effective lights without being intercepted under the influence of the sealing portion 13*b*, etc. In the case where the available limitation lights are the limitation lights determined by the structure of the light emitting tube 10, this exemplary embodiment makes available substantially all the light which is emitted from the light emitting portion 11 onto the rear side of the illumination apparatus 100.

When the diameter d1 of the outer side surface of the second reflector 30 becomes large, light which proceeds frontward after having been reflected by the first reflector 20, is more intercepted, and hence, the utilization factor of light lowers. In order to avoid the lowering of the light utilization factor, accordingly, the diameter d1 of the outer side surface of the second reflector 30 ought to be made as small as possible.

As stated before, owing to the use of such a second reflector 30, a light beam which is radiated from the light emitting portion 11 onto the side opposite to the first reflector 20 (onto the front side) can be reflected onto the rear side by the second reflector 30 so as to enter the reflection surface of the first reflector 20. Therefore, even when the reflection surface of the first reflector 20 is small, almost all of the light beam emitted from the light emitting portion 11 can be emitted in a state where it is converged on a fixed position, the dimension of the first reflector 20 in the optical axis direction thereof and the aperture diameter thereof can be made small. That is, the illumination apparatus 100 and a projector 1000 can be made small in size, and layout for building the illumination apparatus 100 into the projector 1000 is also facilitated.

Because of the provision of the second reflector 30, even when the first focal point F1 and second focal point F2 of the first reflector 20 are brought near to each other in order to make small the diameter of a focused light spot at the second focal point F2, almost all of the light radiated from the light emitting portion 11 is focused on the second focal point by the first reflector 20 and the second reflector 30 and become available, and the utilization factor of the light can be sharply enhanced. Accordingly, the emergent light from the illumination apparatus 100 becomes easy of entering a succeeding optical system, and the light utilization factor can be more enhanced.

The illumination apparatus 100 of this exemplary embodiment constructed as described above, operates as stated below. As shown in FIG. 2, lights L1, L2, L5, L6 emergent from the light emitting portion 11 of the light emitting tube 10 onto the rear side are reflected by the first reflector 20 and proceed frontward of the illumination apparatus 100. Lights L3, L4 emerging from the light emitting portion 11 onto the front side are reflected by the reflection surface 32 of the second reflector 30 and retrocede to the first reflector 20, whereupon they are reflected by the first reflector 20 and proceed frontward of the illumination apparatus 100. Thus, almost all of the emergent light from the light emitting portion 11 is available.

In the illumination apparatus 100 as stated above, the light emitting tube 10 is constructed as described below, as shown in FIG. 1.

(a) The front-side electrode 12*a* surrounded with the second reflector 30 has been made larger than the rear-side electrode 12*b*. This signifies that the heat capacity of the front-side electrode 12*a* surrounded with the second reflector 30, is larger than the heat capacity of the rear-side electrode 12*b*. In correspondence with the enlarged heat capacity of the electrode 12*a*, the heat load of the electrode 12*a* is lightened, and the temperature rise rate thereof lowers to diminish the temperature difference thereof relative to the electrode 12*b*, accordingly, the lifetime and reliability of the light emitting tube 10 can be maintained for a longer term.

(b) The electrode shaft 16*a* which supports the front-side electrode 12*a* surrounded with the second reflector 30 has been made thicker and longer than the electrode shaft 16*b* which supports the rear-side electrode 12*b*. Incidentally, only either the thickness or the length may well be contrived in some cases. In correspondence with the thickened and lengthened electrode shaft 16*a*, heat from the electrode 12*a* becomes easily conducted to the sealing portion by the electrode shaft 16*a*, and the heat radiation of the electrode 12*a* quickens to diminish the temperature difference between the side of the electrode 12*a* and the side of the electrode 12*b* in spite of the installation of the second reflector 30, so that the lifetime and reliability of the light emitting tube 10 can be maintained for a longer term.

(c) The front-side sealing portion 13*a* on which the second reflector 30 is mounted has been made thicker than the rear-side sealing portion 13*b*. In correspondence with the thickened sealing portion 13*a*, the heat capacity of the sealing portion 13*a* increases, so that heat conducted through the electrode shaft 16*a* from the electrode 12*a* becomes easily absorbed by the sealing portion 13*a*, and a rise in temperature of the side of the electrode 12*a* becomes difficult, and the heat radiation area of the sealing portion 13*a* enlarges, so that heat is easily radiated also from the sealing portion 13*a*. Accordingly, the temperature difference between the side of the electrode 12*a* and the side of the electrode 12*b* can be diminished in spite of the installation of the second reflector 30.

(d) The sealing portion 13*a* on the side on which the second reflector 30 is mounted, has been coated with a heat radiation material 17 which has a thermal conductivity higher than that of the material of the sealing portion 13*a*. Owing to the coating with the heat radiation material 17, heat is easily emitted from the sealing portion 13*a*, and hence, rising of the temperature of the sealing portion 13*a* becomes difficult to the corresponding extent, so that heat conducted through the electrode shaft 16*a* from the electrode 12*a* is more easily conducted to the sealing portion 13*a*. Accordingly, the temperature difference between the side of the electrode 12*a* and the side of the electrode 12*b* can be diminished in spite of the installation of the second reflector 30.

Next, the steps of manufacturing the illumination apparatus 100 will be described. Data on the structures of the light emitting tube 10 and the first reflector 20 are collected every light emitting tube 10. The data include the distance between the electrodes 12*a*, 12*b* within the light emitting portion 11, the geometries of the individual parts of the light emitting tube 10, the geometries of the first reflector 20, and the focal point of the first reflector 20 (the first focal point and second focal point in the case where the first reflector 20 is in the shape of the ellipsoid of revolution). Subsequently, on the basis of these data, the emergence state of light from the light emitting portion 11 of each light emitting tube 10 is simulated by utilizing a computer or the like. Next, the design of the second reflector 30 corresponding to each light emitting tube 10 is performed on the basis of the simulation of the emergence state of the light from the light emitting portion 11. The design can also be performed by utilizing a computer simulation or the like, and a shape (an outside diameter, an inside diameter, the shape of the reflection surface 32, etc.) which is capable of fulfilling the operation of the second reflector 30 as already described, is determined through such a simulation. Besides, the second reflector 30 complying with the corresponding light emitting tube 10 is fabricated on the basis of the design. Thereafter, the fabricated second reflector 30 is attached to the sealing portion 13*a* of the light emitting tube 10 while adjustments are being made so that incident lights emitted from the center of the light emitting portion 11 and entering the second reflector 30 may agree with normal lines to the reflection surface 32 of the second reflector 30. Accordingly, the reflection surface 32 of the second reflector 30 may surround substantially the front half of the light emitting portion 11.

Incidentally, from the viewpoint of the structure thereof, the second reflector 30 can be fabricated from a hollow tubular material which has an inside diameter larger than the outside diameter of the sealing portion 13*a* of the light emitting tube 10. In this case, the reflection surface 32 to be formed with the dielectric multilayer film can be formed by polishing a thick-walled part. The polishing in the case of fabricating the second reflector 30 has the advantage that, since the reflection surface 32 is hollow, a complicated polishing control as in ordinary spherical polishing is dispensed with. Besides, the second reflector 30 can be fabricated by the press molding of the above tubular material. The press molding is very simple, and it can greatly curtail a manufacturing cost.

In addition, the attachment of the second reflector 30 to the light emitting tube 10 can be carried out by a method as stated below. (1) While the interspace between the electrodes 12*a*, 12*b* is being observed with a CCD camera or the like, the front half of the light emitting portion 11 and the reflection surface 32 of the second reflector 30 are brought into opposition to each other, and the second reflector 30 is tentatively fixed to the sealing portion 13*a* of the light emitting tube 10. Subsequently, (2) while the reflection surface 32 of the second reflector 30 is being observed in a plurality of different directions with the CCD camera or the like, the position of the second reflector 30 is adjusted so that the image of the interspace between the electrodes 12*a* and 12*b* as thrown upon the reflection surface 32, may enter between the original electrodes (an object point). (3) After the end of the adjustments, the second reflector 30 is fixed to the sealing portion 13*a* of the light emitting tube 10.

The adjustments after the tentative fixation of the second reflector 30 corresponding to the above item (2) are also possible in the following way: A very fine laser beam is projected onto the reflection surface 32 of the second reflector 30 in a plurality of different directions through the interspace between the electrodes 12*a*, 12*b*, and the position of the second reflector 30 is adjusted so that the positions and spreading states of reflected beam lights from the second reflector 30 may agree, whereby the same result as in the case of using the CCD camera is obtained. Thus, reflected light based on the second reflector 30 is permitted to exactly retrocede between the electrodes 12*a*, 12*b* and further to the first reflector 20.

Subsequently, the first reflector 20 and the light emitting tube 10 are arranged in a state where the first focal point of the first reflector 20 is held substantially in agreement with the center between the electrodes of the light emitting tube 10 to which the second reflector 30 has been fixed in the above way. The position of the light emitting tube 10 relative to the first reflector 20 is adjusted so that a brightness at a predetermined position may become the maximum, whereupon the light emitting tube 10 and the first reflector 20 are fixed at the appropriate position.

Incidentally, the attachment of the second reflector 30 to the light emitting tube 10 is performed by securing the second reflector 30 to the sealing portion 13*a* of the light emitting tube 10. The securing can be resorted to, for example, binding with a cement or an inorganic type adhesive whose principal ingredient is a silica/alumina mixture or aluminum nitride capable of enduring high temperatures and favorable in thermal conductivity as stated before. Trade name "Sumiceram" (produced by Asahi Chemical Co., Ltd., and "Sumiceram" is a trademark of Sumitomo Chemical Co., Ltd.) is mentioned as an example of the inorganic type adhesive. Alternatively, the second reflector 30 can also be secured to the sealing portion 13*a* in such a way that the sealing portion 13*a* or/and the second reflector 30 is/are provided with a fusion welding part/fusion welding parts, and that both the members are fusion-welded using a laser or a gas burner. In the case of using the laser, the laser irradiation part sometimes blackens, but the blackening poses no problem because the place to be secured is the sealing portion 13*a*.

Second Exemplary Embodiment

Figure 3:
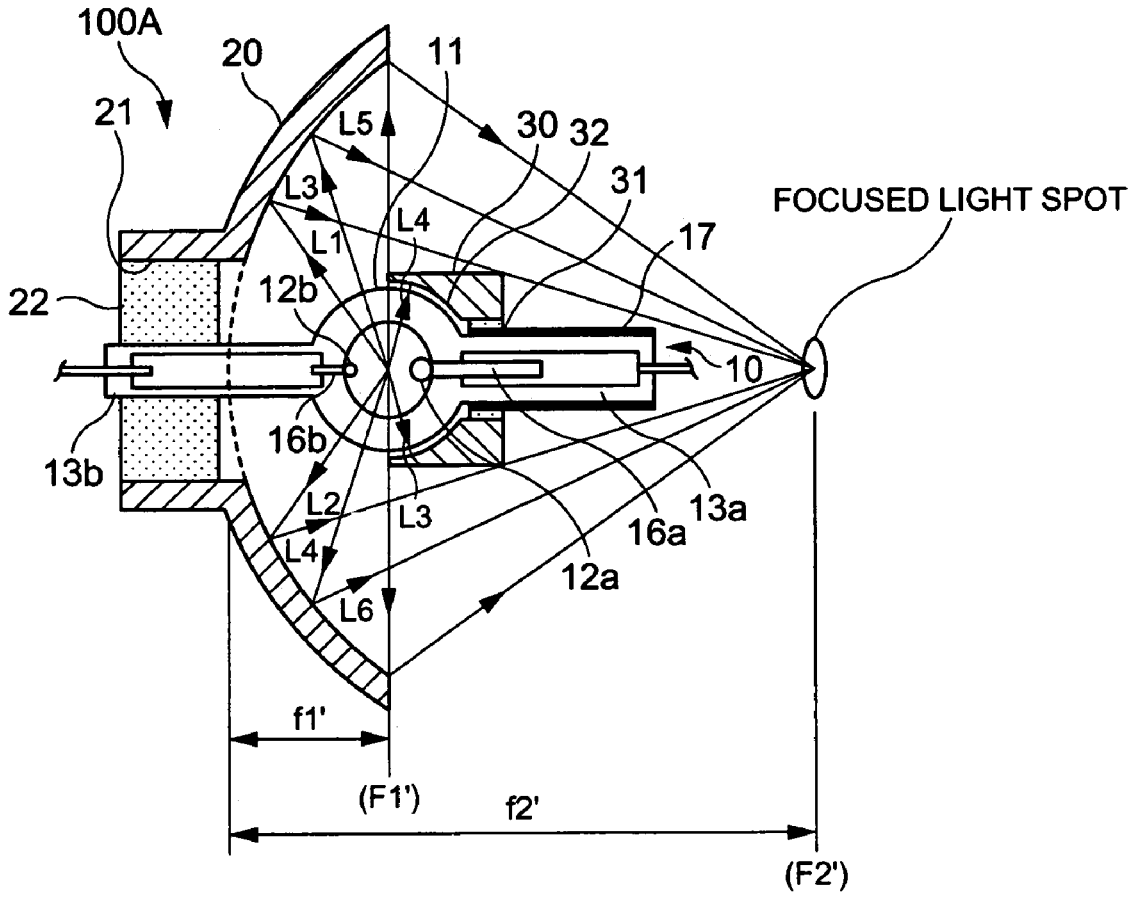
FIG. 3 is a schematic constructional view and schematic operational diagram showing an illumination apparatus according to the second exemplary embodiment of the present invention.

FIG. 3 is a schematic constructional view as well as a schematic that shows an illumination apparatus 100A according to the second exemplary embodiment of the present invention. The construction of the illumination apparatus 100A is basically the same as that of the illumination apparatus 100 of the first exemplary embodiment shown in FIGS. 1 and 2, and a point of difference thereof from the illumination apparatus 100 of the first exemplary embodiment is the following point:

(e) The end parts of a pair of electrodes 12*a*, 12*b* are respectively held in touch with the inner surface of a light emitting tube 10.

By the way, in some cases, only the front-side electrode 12*a* surrounded with a second reflector 30 may well be held in touch with the inner surface of the light emitting tube 10.

Owing to such a construction of the second exemplary embodiment, in addition to the advantages of the first exemplary embodiment as stated before, there is brought forth the advantage that, since the end parts/part of the electrode 12*a* and/or the electrode 12*b* are/is held in touch with the inner surface of the light emitting tube 10, the heats/heat of the electrode 12*a* and/or 12*b* are/is conducted to the light emitting tube 10, to make the rising of the temperatures/temperature of the electrode 12*a* and/or 12*b* difficult, so that the lifetime and reliability of the light emitting tube 10 can be maintained for a longer term.

Third Exemplary Embodiment

Figure 4:
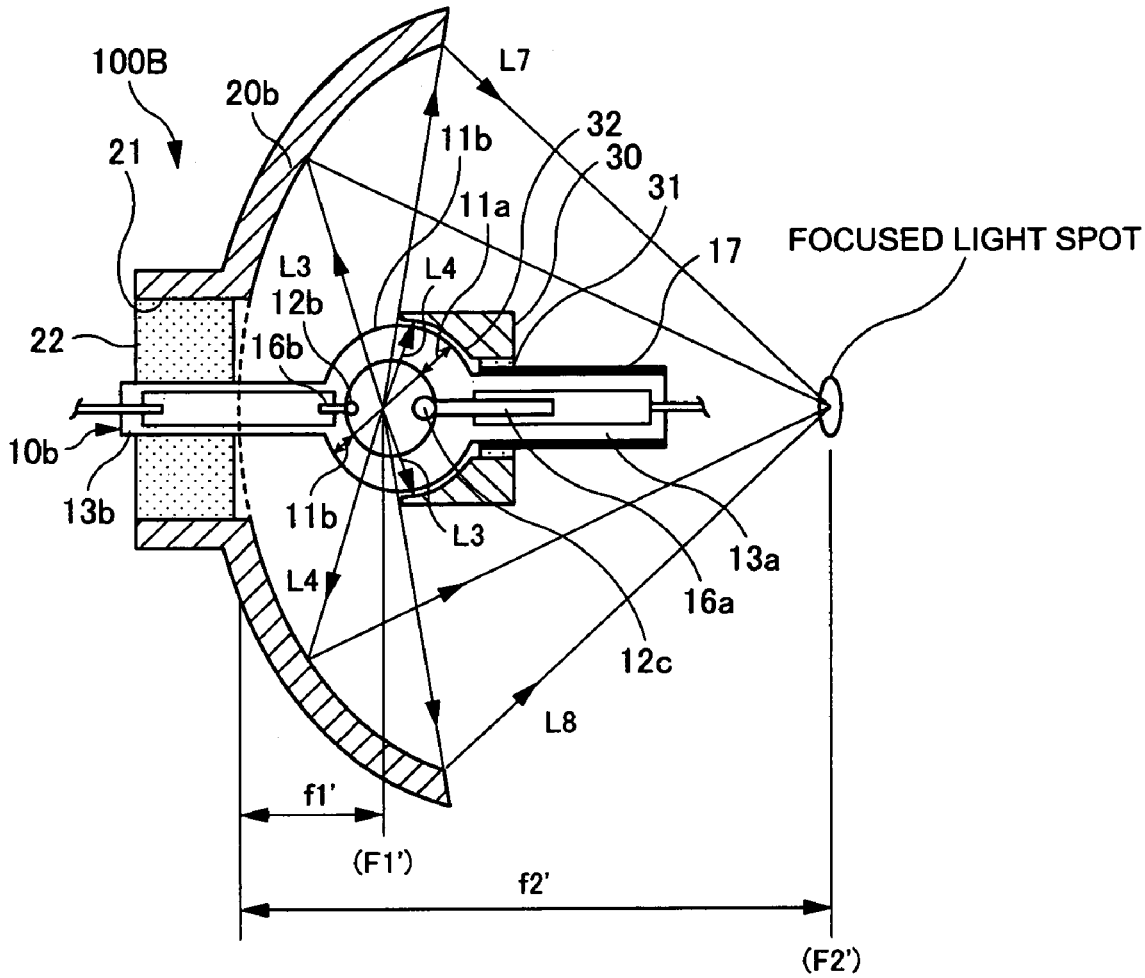
FIG. 4 is a schematic constructional view showing an illumination apparatus according to the third exemplary embodiment of the present invention.

Further, FIG. 4 is a schematic constructional view as well as a schematic that shows an illumination apparatus 100B according to the third exemplary embodiment of the present invention. The construction of the illumination apparatus 100B is basically the same as that of the illumination apparatus 100A of the second exemplary embodiment shown in FIG. 3, and a point of difference thereof from the illumination apparatus 100A of the second exemplary embodiment is the following point:

(f) The light-emitting-portion wall thickness 111*a* of that front side of the light emitting portion 11*b* of a light emitting tube 10*b* which is surrounded with a second reflector 30 has been made greater than the light-emitting-portion wall thickness 111*b* of the rear side of the light emitting portion 11*b*. In this case, it is especially favorable to gradually change the light-emitting-portion wall thickness 111*a* of the front side of the light emitting portion 11*b* and that 111*b* of the rear side thereof in correspondence with the heat generation situation of the light emitting tube 10*b*. In the part of the light emitting portion 11*b* of the light emitting tube 10*b*, the light-emitting-portion wall thickness 111*a* of the front side being the side which is surrounded with the second reflector 30 is greater than the light-emitting-portion wall thickness 111*b* of the rear side.

Incidentally, since the light-emitting-portion wall thickness 111*a* of the front side of the light emitting portion 11*b* is greater than the light-emitting-portion wall thickness 111*b* of the rear side, the center of the outside diameter of the light emitting portion 11*b* and the center between electrodes 12*c* and 12*d* deviate in the optical axis direction of the illumination apparatus 100B. Accordingly, a first reflector 20*b* in the third exemplary embodiment is larger in the aperture diameter of a reflection surface than the first reflector 20 in the first exemplary embodiment so that lights L7, L8 from the light emitting portion 11*b* can be reflected.

Owing to such a construction of the third exemplary embodiment, in addition to the advantages of the first and second exemplary embodiments as stated before, there is brought forth the advantage that, in the part of the light emitting portion 11*b* of the light emitting tube 10*b*, the light-emitting-portion wall thickness 111*a* of the front side of the light emitting portion 11*b* is greater than the light-emitting-portion wall thickness 111*b* of the rear side. Thus, the heat capacity of the front side being the side which is surrounded with the second reflector 30 becomes large to make rising of the temperature of the front side of the light emitting portion 11*b* difficult. Accordingly, the temperature difference between the front side and rear side of the light emitting portion 11*b* is diminished in spite of the installation of the second reflector 30, so that the lifetime and reliability of the light emitting tube 10*b* can be maintained for a longer term.

Fourth Exemplary Embodiment

Figure 5A:
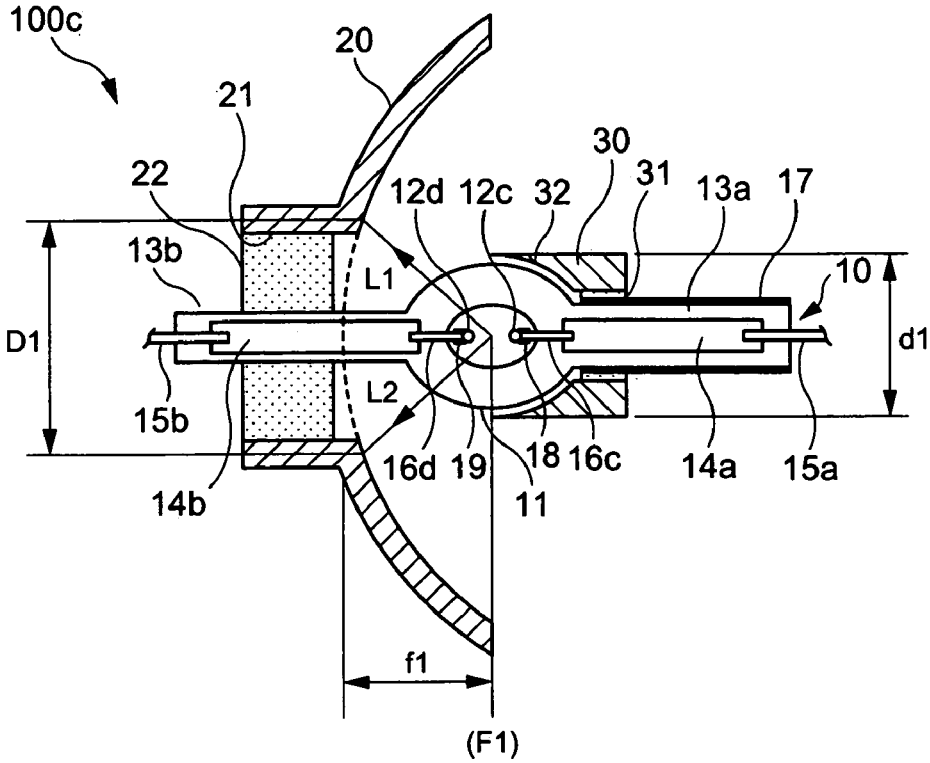
FIG. 5A is a schematic constructional view showing an illumination apparatus according to the fourth exemplary embodiment of the present invention.
Figure 5B:
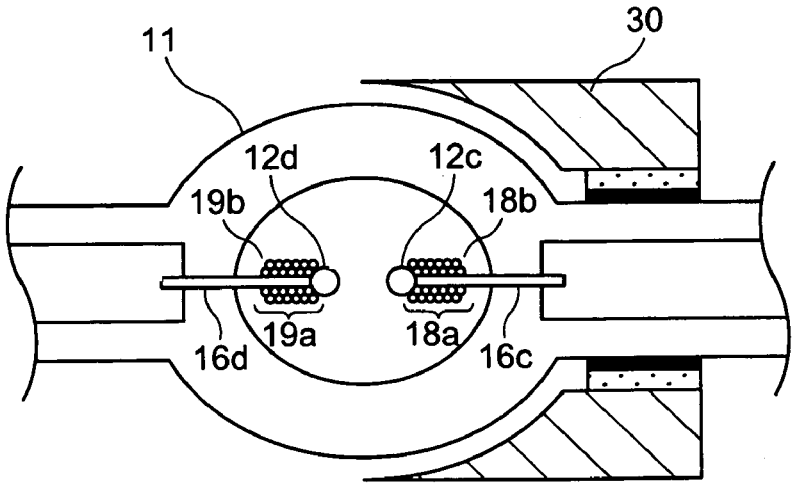
FIG. 5B is a schematic constructional view showing the light emitting portion of the illumination apparatus according to the fourth exemplary embodiment of the present invention.

FIGS. 5A and 5B are constructional views of an illumination apparatus 100C according to the fourth exemplary embodiment of the present invention. The illumination apparatus 100C is similar to the illumination apparatus 100 of the first exemplary embodiment shown in FIGS. 1 and 2, and when it is compared with the illumination apparatus 100 of the first exemplary embodiment, the configuration of a pair of electrodes 12*c*, 12*d* differs from that of the electrodes 12*a*, 12*b* in the first exemplary embodiment. The details are as follows:

(g) As shown in FIG. 5A, the electrodes 12*c* and 12*d* have an identical shape, and also electrode shafts 16*c*, 16*d* have an identical shape. The electrode shaft 16*c* is furnished with a heat conduction part 18 at its end on a side on which it is connected with the electrode 12*c*. The heat conduction part 18 is made up of a coil 18*a* which is formed by winding tungsten wire 18*b*. The electrode shaft 16*d* is furnished with a heat conduction part 19 at its end on a side on which it is connected with the electrode 12*d*. The heat conduction part 19 is made up of a coil 19*a* which is formed by winding tungsten wire 19*b*. Although the coils 18*a* and 19*a* are formed of substantially equal numbers of turns, the diameter of the tungsten wire 18*b* is larger than that of the tungsten wire 19*b*.

Incidentally, it is also allowed to adopt a configuration in which the same tungsten wire is employed for the coils 18*a* and 19*a*, and in which the number of turns of the tungsten wire of the coil 18*a* is made larger than the number of turns of the tungsten wire of the coil 19*a*. In short, the coils 18*a* and 19*a* may be respectively formed so as to make the heat capacity of the heat conduction part 18 larger than that of the heat conduction part 19. By way of example, the diameters of the tungsten wires 18*b* and 19*b*, or the numbers of turns of the tungsten wires 18*b* and 19*b* are regulated so as to make the heat capacity of the heat conduction part 18 larger than that of the heat conduction part 19 to the extent of 12%. Besides, the way of winding the tungsten wire 18*b* or 19*b* may be a method in which the tungsten wire is wound in multiple layers in the thickness direction of the coil 18*a* or 19*a* as shown in FIG. 5B, or a method in which the tungsten wire is wound in a single layer along the electrode shaft 16*c* or 16*d*.

Owing to such a construction of the fourth exemplary embodiment, although the same members are used for the electrode shafts 16*c*, 16*d* and for the electrodes 12*c*, 12*d*, the heat conduction part 18 is larger in the heat capacity than the heat conduction part 19, and hence, the heat of the electrode 12*c* near which a second reflector 30 is arranged can be easily radiated, so that the heat load of the electrode 12*c* is lightened to lower the temperature rise rate thereof, and to diminish the temperature difference thereof relative to the electrode 12*d*. Accordingly, the lifetime and reliability of the light emitting tube 10 can be maintained for a longer term.

Incidentally, the first exemplary embodiment has shown an example of the combination of the above items (a)-(d), and the second through fourth exemplary embodiments have shown examples in which the above items (e)-(g) are further combined into the first exemplary embodiment, but the items (a)-(g) may well be respectively adopted individually, or they may well be adopted in any desired combination. Further, the adoption of the above items (a)-(g) is not restricted to the foregoing exemplary embodiments, but it is applicable to another light emitting tube or illumination apparatus in which a second reflector is mounted so that its reflection surface may surround substantially the half of a light emitting portion. Besides, owing to the adoption of such a structure, the illumination apparatus 100, 100A, 100B or 100C can enhance its illumination efficiency with the shortening of its lifetime avoided.

Although a projector 1000 including the illumination apparatus 100 will be described below, the illumination apparatus 100A, 100B or 100C can similarly constitute a projector 1000.

Figure 6:
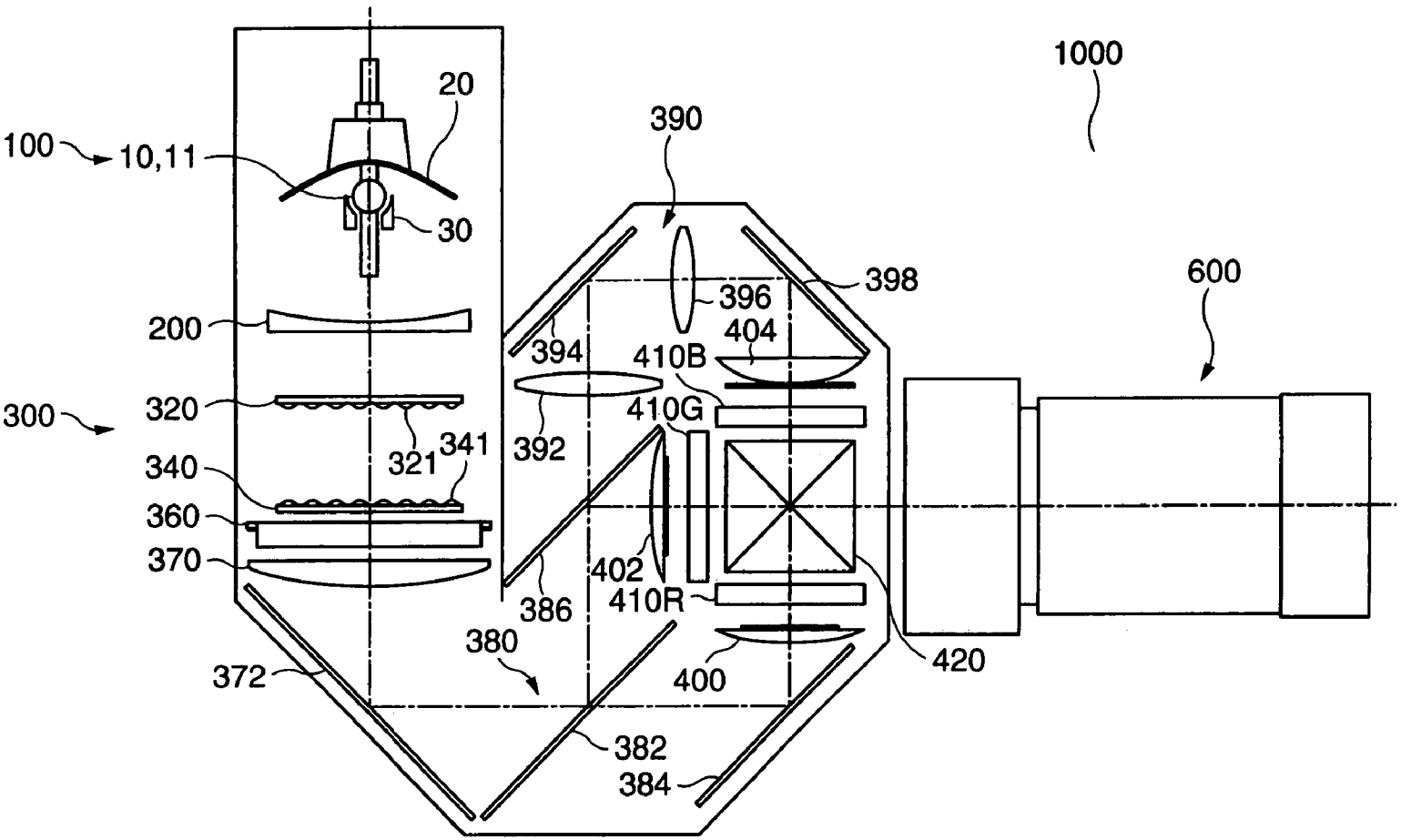
FIG. 6 is a schematic constructional view showing a projector which includes the illumination apparatus according to the above exemplary embodiment.

FIG. 6 is a schematic constructional view of the projector 1000 which includes the illumination apparatus 100. The optical system includes the illumination apparatus 100 which is configured of a light emitting tube 10, a first reflector 20 and a second reflector 30; an illuminating optical system 300 which includes an adjustment device to adjust emergent light from the illumination apparatus 100 into predetermined light; a colored light separating optical system 380 which has dichroic mirrors 382, 386, a reflection mirror 384, etc.; a relay optical system 390 which has an entrance side lens 392, a relay lens 396, and reflection mirrors 394, 398; field lenses 400, 402, 404 which correspond to respective colored lights, and liquid crystal panels 410R, 410G, 410B which are optical modulation devices; a cross-dichroic prism 420 which is a colored light synthesizing optical system; and a projection lens 600.

Next, the operation of the projector 1000 of the above construction will be described.

First, emergent light from a rear side with respect to the center of the light emitting portion 11 of the light emitting tube 10 is reflected by the first reflector 20 and proceeds frontward of the illumination apparatus 100. Besides, emergent light from a front side with respect to the center of the light emitting portion 11 is reflected by the second reflector 30 and retrocedes to the first reflector 20, whereupon it is reflected by the first reflector 20 and proceeds frontward of the illumination apparatus 100.

Light having come out of the illumination apparatus 100 enters a concave lens 200, and its traveling direction is adjusted therein so as to become substantially parallel to the optical axis 1 of the illuminating optical system 300. As such, the resulting light enters the individual small lenses 321 of a first lens array 320 which constructs an integrator lens. The first lens array 320 divides the entered light into a plurality of partial light beams which correspond to the number of the small lenses 321. The partial light beams having come out of the first lens array 320 enter a second lens array 340 which constructs an integrator lens that has small lenses 341 respectively corresponding to the small lenses 321. Besides, emergent light beams from the second lens array 340 are focused on the vicinities of the corresponding polarization separating films (not shown) of a polarization transducer array 360. On that occasion, light which falls on the polarization transducer array 360 is adjusted so as to enter only parts corresponding to the polarization separating films.

In the polarization transducer array 360, the light beams having entered it are converted into linear polarizations of the same sort. Besides, a plurality of partial beams whose polarization directions are uniformalized by the polarization transducer array 360 enter a superposition lens 370, in which the individual partial light beams to illuminate the liquid crystal panels 410R, 410G, 410B are adjusted so as to be superposed on one another on the corresponding panels.

The colored light separating optical system 380 includes the first and second dichroic mirrors 382 and 386, and it has the function of separating the light emitted from the illuminating optical system, into colored lights in the three colors of red, green and blue. The first dichroic mirror 382 transmits the red light component of the light emitted from the superposition lens 370, and reflects the blue light component and green light component of the light. The red light transmitted through the first dichroic mirror 382 is reflected by the reflection mirror 384, and it passes through the field lens 400 to reach the liquid crystal panel 410R for the red light. The field lens 400 converts the individual partial light beams emitted from the superposition lens 370, into light beams parallel to the center axis (principal light ray) thereof. The field lenses 402, 404 disposed in front of the other liquid crystal panels 410G, 410B operate similarly.

Further, of the blue light and green light reflected by the first dichroic mirror 382, the green light is reflected by the second dichroic mirror 386 and passes through the field lens 402 to reach the liquid crystal panel 410G for the green light. On the other hand, the blue light is transmitted through the second dichroic mirror 386, and it passes through the relay optical system 390. That is, the entrance side lens 392, reflection mirror 394, relay lens 396 and reflection mirror 398, and further passes through the field lens 404 to reach the liquid crystal panel 410B for the blue light. Incidentally, the reason why the relay optical system 390 is employed for the blue light is that, since the optical path length of the blue light are greater than those of the other colored lights, the utilization efficiency of the light is to be prevented from lowering due to the divergence, etc. of the light. That is, the partial light beams having entered the entrance side lens 392 are to be conveyed to the field lens 404 as they are. By the way, although the relay optical system 390 is configured so as to pass the blue light of the three colored lights, it may well be configured so as to pass the other colored light such as red light.

The three liquid crystal panels 410R, 410G, 410B modulate the entered colored lights in accordance with given image information, thereby to form the images of the respective colored lights. Incidentally, polarizer plates are usually disposed on the light entrance plane sides and light exit plane sides of the three liquid crystal panels 410R, 410G, 410B.

The modulated lights of the three colors emitted from the respective liquid crystal panels 410R, 410G, 410B enter the cross-dichroic prism 420 which functions as the colored light synthesizing optical system that synthesizes the modulated lights to form a color image. In the cross-dichroic prism 420, a dielectric multilayer film reflecting the red light, and a dielectric multilayer film reflecting the blue light are formed substantially in the shape of letter X on the interfaces of four right-angle prisms. Owing to the dielectric multilayer films, the modulated lights of the three colors of red, green and blue are synthesized, and synthetic light to project the color image is formed. Besides, the synthetic light synthesized by the cross-dichroic prism 420 enters the projection lens 600 finally so as to be projected therefrom and displayed as the color image on a screen.

According to the projector 1000, the higher brightness and longer lifetime of the projector 1000 can be attained by the already-explained operation of the illumination apparatus 100 or 10A, 100B or 100C which is employed in this projector and which is configured of the light emitting tube 10, first reflector 20 and second reflector 30.

Incidentally, the projector of the present invention is not restricted to the above exemplary embodiments, but it can be performed in various exemplary aspects within a scope not departing from the purport of the invention, and exemplary modifications as stated below are also possible by way of example.

Although the two lens arrays 320, 340 to divide the light of the illumination apparatus 100 into the plurality of partial light beams have been employed in the exemplary embodiment, this invention is also applicable to a projector which does not employ such a lens array.

Although the example of the projector employing the liquid crystal panels as the optical modulation devices has been described in the exemplary embodiment, the present invention can also be applied to a projector which employs modulation devices other than the liquid crystal panels, for example, modulation devices that have pixels constructed of micromirrors.

Although the example of the projector employing the optical modulation devices in the number of three has been described in the exemplary embodiment, the present invention can also be applied to a projector which employs one optical modulation device, two optical modulation devices, or four or more optical modulation devices.

Although the projector employing the liquid crystal panels of transmission type has been exemplified in the exemplary embodiment, the present invention can also be applied to a projector which employs liquid crystal panels of reflection type. Here, the "transmission type" signifies that the optical modulation device such as liquid crystal panel is of the type which transmits light, while the "reflection type" signifies that it is of the type which reflects light. Besides, the optical modulation device is not restricted to the liquid crystal panel, but it may well be, for example, a device which employs micromirrors. Further, the illuminating optical system of exemplary embodiments of the present invention are applicable to both a front projection type projector which performs projection in the direction of observation, and a rear projection type projector which performs projection from an opposite side to the direction of observation.

The invention claimed is:

1. An illumination apparatus, comprising:

a light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion; and a heat capacity of the front-side electrode of the pair of electrodes that is surrounded with the second reflector, being made larger than a heat capacity of the rear-side electrode.

2. The illumination apparatus according to claim 1, wherein an end part of at least one of the pair of electrodes being held in touch with an inner surface of the light emitting tube.

3. An illumination apparatus, comprising:

a light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion; and the electrode shaft which supports the front-side electrode of the pair of electrodes that is surrounded with the second reflector being made thicker and/or longer than the electrode shaft which supports the rear-side electrode.

4. The illumination apparatus according to claim 3, wherein an end part of at least one of the pair of electrodes being held in touch with an inner surface of the light emitting tube.

5. An illumination apparatus, comprising:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion; and the sealing portion located on the front side being made thicker than the sealing portion located on the rear side.

6. The illumination apparatus according to claim 5, wherein an end part of at least one of the pair of electrodes being held in touch with an inner surface of light emitting tube.

7. An illumination apparatus, comprising:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion; and the sealing portion located on the front side being coated with a heat radiation material which is higher in thermal conductivity than a material of the sealing portion.

8. The illumination apparatus according to claim 7, wherein an end part of at least one of the pair of electrodes being held in touch with an inner surface of said light emitting tube.

9. An illumination apparatus, comprising:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion; and a wall thickness of the front side of the light emitting portion of the light emitting tube which is surrounded with the second reflector being greater than a wall thickness of a rear side of the light emitting portion.

10. The illumination apparatus according to claim 9, wherein an end part of at least one of the pair of electrodes being held in touch with an inner surface of the light emitting tube.

11. An illumination apparatus, comprising:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion; and an end part of the front-side electrode of the pair of electrodes that is surrounded with the second reflector being held in touch with an inner surface of the light emitting tube.

12. An illumination apparatus, comprising:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion, the second reflector being attached to the sealing portion located on the front side, so that its reflection surface may surround substantially a front half of the light emitting portion;

a pair of electrode shafts being respectively furnished with heat conduction parts at their end parts on sides on which they are connected with the pair of electrodes; and a heat capacity of the heat conduction part of the front-side electrode of the pair of electrodes that is surrounded with the second reflector being made larger than a heat capacity of the heat conduction part of the rear-side electrode.

13. A projector, comprising:

an illumination apparatus;

an optical modulation device into which light from the illumination apparatus is entered and which modulates the entered light in accordance with given image information;

the illumination apparatus being an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrodes shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube, and a second reflector arranged on a front side with respect to light emitting portion;

the second reflector being attached to the sealing portion located on the front side, so that its reflection surface may surround substantially a front half of the light emitting portion; and a heat capacity of the front-side electrode of the pair of electrodes that is surrounded with the second reflector being made larger than a heat capacity of the rear-side electrode.

14. The projector according to claim 13, wherein an end part of at least one of the pair of electrodes being held in touch with an inner surface of the light emitting tube.

15. A projector, comprising:

an illumination apparatus; and an optical modulation device into which light from the illumination apparatus is entered and which modulates the entered light in accordance with given image information;

the illumination apparatus being an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion;

the second reflector being attached to the sealing portion located on the front side, so that its reflection surface may surround substantially a front half of the light emitting portion; and the electrode shaft which supports the front-side electrode of the pair of electrodes that is surrounded with the second reflector being made thicker and/or longer than an electrode shaft which supports the rear-side electrode.

16. The projector according to claim 15, wherein an end part of at least one of the pair of electrodes being held in touch with an inner surface of the light emitting tube.

17. A projector, comprising:

an illumination apparatus; and an optical modulation device into which light from the illumination apparatus is entered and which modulates the entered light in accordance with given image information;

the illumination apparatus is an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion;

the second reflector being attached to the sealing portion located on the front side, so that its reflection surface may surround substantially a front half of the light emitting portion; and the sealing portion located on the front side being made thicker than the sealing portion located on the rear side.

18. The projector according to claim 17, wherein an end part of at least one of the pair of electrodes being held in touch with an inner surface of the light emitting tube.

19. A projector, comprising:

an illumination apparatus; and an optical modulation device into which light from the illumination apparatus is entered and which modulates the entered light in accordance with given image information;

the illumination apparatus is an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion;

the second reflector being attached to the sealing portion located on the front side, so that its reflection surface may surround substantially a front half of the light emitting portion; and the sealing portion located on the front side being coated with a heat radiation material which is higher in thermal conductivity than a material of the sealing portion.

20. The projector according to claim 19, wherein an end part of at least one of the pair of electrodes being held in touch with an inner surface of the light emitting tube.

21. A projector, comprising:

an illumination apparatus; and an optical modulation device into which light from the illumination apparatus is entered and which modulates the entered light in accordance with given image information;

the illumination apparatus is an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion;

the second reflector being attached to the sealing portion located on the front side, so that its reflection surface may surround substantially a front half of the light emitting portion; and a wall thickness of that front side of the light emitting portion of the light emitting tube which is surrounded with the second reflector being greater than a wall thickness of a rear side of the light emitting portion.

22. The projector according to claim 21, wherein an end part of at least one of the pair of electrodes being held in touch with an inner surface of the light emitting tube.

23. A projector, comprising:

an illumination apparatus; and an optical modulation device into which light from the illumination apparatus is entered and which modulates the entered light in accordance with given image information;

the illumination apparatus is an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed in the sealing portions respectively, light emission between the pair of electrodes being performed in the light emitting portion, the light emitting portion being interposed between the sealing portions;

a first reflector arranged on a rear side with respect to the light emitting portion of the light emitting tube;

a second reflector arranged on a front side with respect to the light emitting portion;

the second reflector being attached to the sealing portion located on the front side, so that its reflection surface may surround substantially a front half of the light emitting portion; and an end part of the front-side electrode of the pair of electrodes that is surrounded with the second reflector being held in touch with an inner surface of the light emitting tube.

24. A projector, comprising:

an illumination apparatus; and an optical modulation device into which light from the illumination apparatus is entered and which modulates the entered light in accordance with given image information;

the illumination apparatus is an illumination apparatus further including:

light emitting tube having a pair of electrodes, electrode shafts, leads, metal foils, a light emitting portion and sealing portions, electrode shafts supporting the corresponding electrodes, one end of the metal foils being connected with the corresponding electrode shafts, other end of the metal foils being connected with the corresponding leads, at least the metal foils being sealed portions respectively, light emission between the pair of electrodes being performed in the light emitting portion, the light emitting portion being interposed between the sealing portions;

a first reflector arranged on a rear side with respect to the light emitting portion of the light emitting tube; and a second reflector arranged on a front side with respect to the light emitting portion;

the second reflector being attached to the sealing portion located on the front side, so that its reflection surface may surround substantially a front half of the light emitting portion;

a pair of electrode shafts being respectively furnished with heat conduction parts at their end parts on sides on which they are connected with the pair of electrodes; and a heat capacity of the heat conduction part of the front-side electrode of the pair of electrodes as is surrounded with the second reflector being made larger than a heat capacity of the heat conduction part of the rear-side electrode.

* * * * *